US005178064A

United States Patent [19]

Kerber et al.

[11] Patent Number: 5,178,064

[45] Date of Patent: Jan. 12, 1993

[54] THERMAL REGULATOR FOR A PRINTING FORM LAID ABOUT A PRINTING FORM CYLINDER FOR ANAQUEOUS OFFSET PRINTING

[75] Inventors: Helmut Kerber, Rodermark; Peter Mayer, Muhleim am Main, both of Fed. Rep. of Germany

[73] Assignee: MAN Roland Druckmasachinen AG, Fed. Rep. of Germany

[21] Appl. No.: 774,528

[22] Filed: Oct. 8, 1991

[30] Foreign Application Priority Data

Oct. 8, 1990 [DE] Fed. Rep. of Germany ..... 4031859

[51] Int. Cl.[5] ..... B41F 7/00; B41F 23/04

[52] U.S. Cl. ..... 101/130; 101/487

[58] Field of Search ..... 101/130, DIG. 45, 487, 101/484, 424.1, 483, 488, 424.2

[56] References Cited

U.S. PATENT DOCUMENTS

| | | | |
|---|---|---|---|
| 2,971,460 | 2/1961 | Shindle | 101/487 |
| 4,920,881 | 5/1990 | Tafel | 101/424.1 |
| 5,074,213 | 12/1991 | Kurosawa | 101/487 |

*Primary Examiner*—Clifford D. Crowder
*Assistant Examiner*—J. R. Keating
*Attorney, Agent, or Firm*—Leydig, Voit & Mayer

[57] ABSTRACT

In order to create a thermal regulator for a printing form (2) for anaqueous offset printing, a blast box (3) is provided for the blowing of the printing form (2) with tempered air, in which fans (4) and a cooler (5) are mounted, which is supplied from outside with a coolant (7) from a cooling installation (6), the cooling of the cooler (5) being regulated in dependence on a temperature of a regulator (8).

3 Claims, 1 Drawing Sheet

THERMAL REGULATOR FOR A PRINTING FORM LAID ABOUT A PRINTING FORM CYLINDER FOR ANAQUEOUS OFFSET PRINTING

FIELD OF THE INVENTION

The invention relates to a thermal regulator for a printing form about a printing form cylinder in anaqueous offset printing system.

BACKGROUND OF THE INVENTION

In contrast to conventional offset printing in which the work is done with a moistening agent, in anaqueous offset printing a special silicone layer keeps the non-printing places of the printing form free of ink. This property of the silicone surface collapses above a certain temperature, which is about 35° C. The optimal operating temperature is 25° C. or below.

From the journal "Offsetpraxis" 4/1990, pages 38 to 46, it is known, as an alternative to an inking mechanism roller tempering, in which as cooling medium a fluid is used, in anaqueous offset printing to blast the printing form laid about the printing form cylinder with cold air at a certain angle so that the printing form temperature can be maintained constant at the above-mentioned operating temperature. In such offset printing presses a blast box installed instead of the conventional moistening roller system distributes the cold air onto the printing form over the whole width of the printing form cylinder. For this purpose the blast box is connected with a thick air feed tube which transports cold air from a cooling installation set up beside the printing press to the printing form cylinder of the printing mechanism. In such printing form cylinder cooling, not only is the appearance of the printing press disturbed by the thick long air feed tubes that must be assembled, but also the accessibility to the printing mechanisms is hampered.

In connection with the blasting of the printing form by means of cold air, tempering is also a concern, because besides cooling there also occurs a warming until the surface of the printing form, in the case of a cold printing press, is brought to the optimal operating temperature of, for example, 25° C. The need therefor exists for a thermal regulator for the printing form. Moreover, it is a problem to create a thermal regulator for a printing form laid about a printing form cylinder for anaqueous offset printing, which makes it possible to blast the printing form by means of tempered air which is generated directly in the zone of the printing form cylinder. The present invention is directed to a solution to these problems.

SUMMARY OF THE INVENTION

An advantage of the invention lies in that the appearance of an offset printing press for anaqueous offset printing is no longer disturbed, because of the absence of the thick long air feed tubes. Also the associated impairment of the accessibility to the printing mechanisms is eliminated. Further , through the compact construction there occur less temperature losses of the air to be brought in and relatively short regulating times are achievable. Furthermore, any conventional offset printing press can be equipped in a simple manner, by removing the moisture applicator rollers and suspending the blast box of the invention in the printing press and thereupon connecting it to moistening agent cooling devices present. Further, the machine can at any time be re-equipped for the normal offset process. Additional cooling installations or other assemblies besides the printing press are no longer required, since the moistening-agent cooling devices present already are integrated into conventional printing presses for offset printing. Since the printing form cylinder heats slowly in operation and the printing form, furthermore, is additionally insulated by underlay sheets, no great cooling performance is required for the tempering.

BRIEF DESCRIPTION OF THE DRAWINGS

The invention is explained in detail with the aid of the drawing in which.

Figure 2:
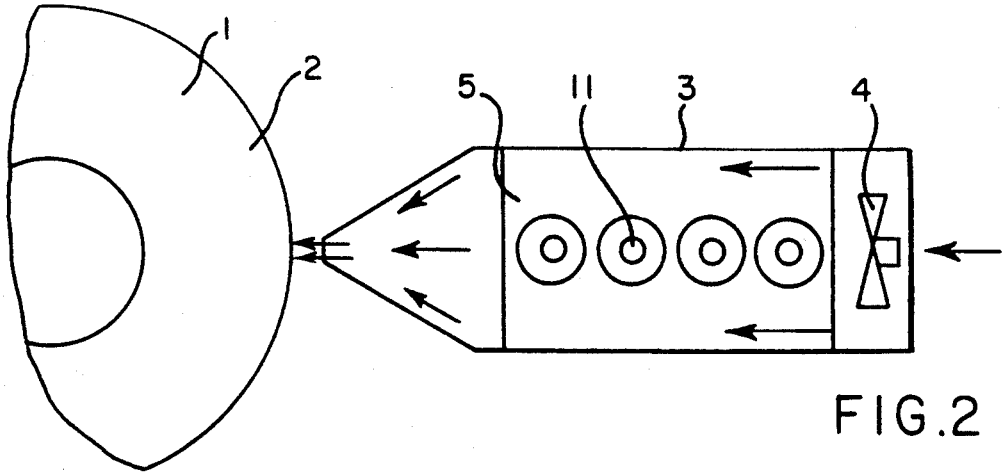
FIG. 2 is a vertical section taken in the plane of line A–B in FIG. 1.
Figure 1:
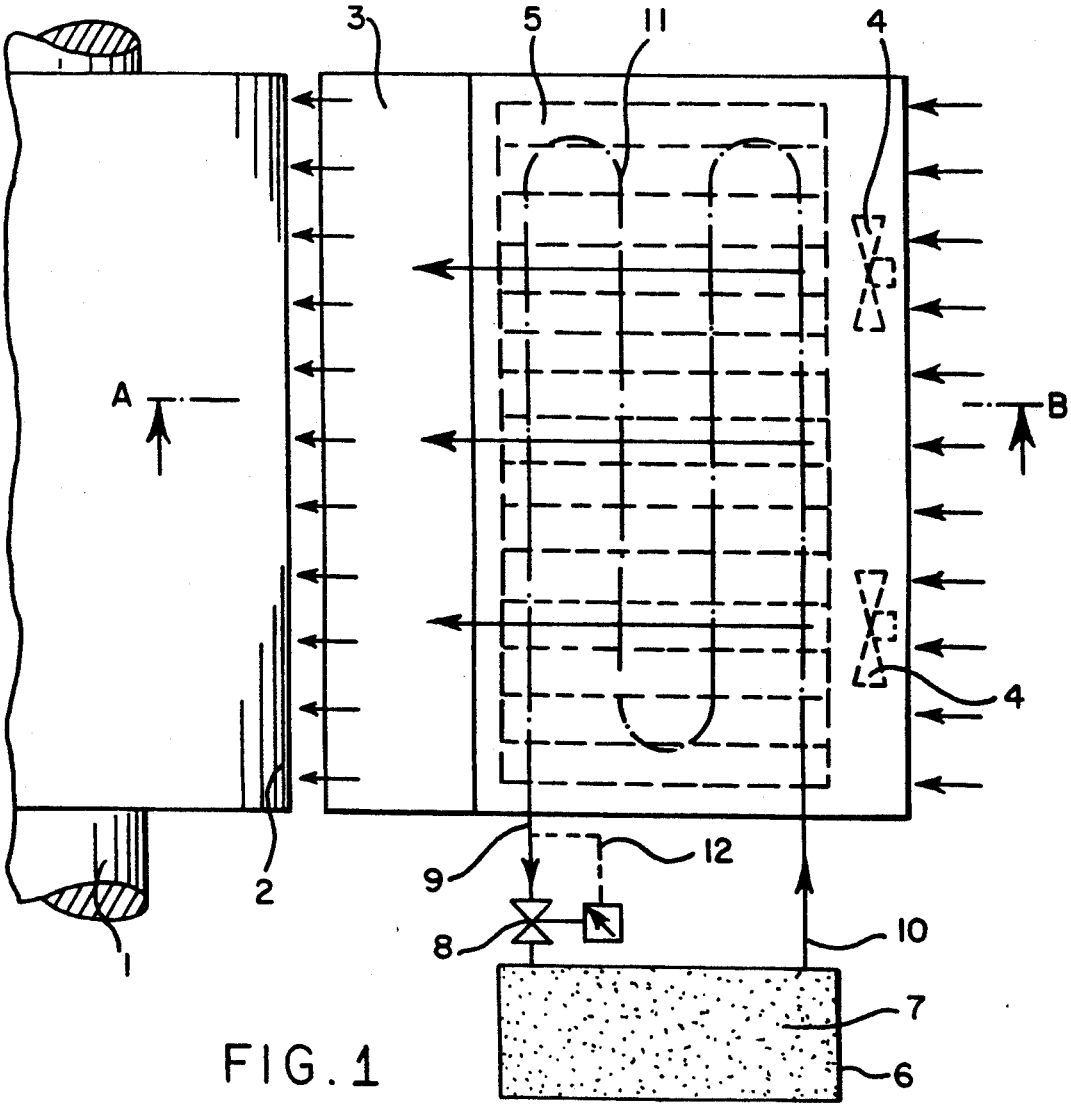
FIG. 1 is a schematic, plan view of a thermal regulator arrangement according to the present invention in an anaqueous offset printing press.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE INVENTION

The construction and the functioning of an offset printing press for anaqueous offset printing are known, and therefore, do not require detailed explanation in the present context. It should be pointed out merely that the print image in such offset printing presses is transferred first to a cylinder spanned with a rubber blanket and from this onto the material to be imprinted. For this purpose, in the illustrated embodiment, the printing form 2 presenting the print image is laid about a printing form cylinder 1.

For blasting tempered air onto the printing form 2, a blast box 3 is provided which has blast openings lying opposite the printing form cylinder, which blasts or directs air at a determined angle. The blast box 3 in this case extends over the entire width of the printing form cylinder 1. It preferably is installed in the offset printing press instead of a conventional roller moistening mechanism.

In order to make it possible to generate the blast air to be tempered directly in the zone of the printing form cylinder in front of the printing cylinder, there is provided at least one fan 4, which is mounted inside the blast box 3. In front of the fan 4 there is provided in the flow direction of the blast air a cooler 5 which is supplied with a coolant 7, preferably water, from a cooling installation outside the blast box 3. For example, a cooling hose 11 for coolers 5 having rib tubes is suitable. In the transverse flow of the blast air with use of spacing rib tubes there is achieved a good heat transition, with low cooling performance.

The cooling hoses 11 in this case are connected with a water inflow line 10 and a water off-flow line 9 of a cooling installation 6, which preferably in the form of a water cooling apparatus, for example a commercially known moistening water cooling apparatus.

Finally there is provided a measuring sensor 12 detecting the temperature of the coolant 7 and a regulator 8 which regulates the cooling of the cooler 5 in dependence on the temperature of the coolant 7. For this purpose a thermostatically controllable choke valve is well suited, which is provided in the water off-flow line 9.

Alternately the fans 4 may be intermittently operated, as regulated by a thermostat, for example in dependence on the temperature of the blast air on the output side. In which case in the vicinity of the printing form 2 at the exit openings of the blast box 3 a measuring sensor detecting the temperature of the tempered blast air could be provided for controlling a switch in the current circuit of the fan. Operation of the fans in response to the temperature, therefor, could be controlled in a known manner.

What is claimed is:

1. In an anaqueous offset printing system having a printing form on a form cylinder journalled for rotation on an offset printing press, a printing form thermal regulator system, comprising: a blast box mounted on the printing press and located directly proximate the form cylinder, said blast box having one or more blast opening means for directing an air flow onto the printing form, said blast box being of compact construction and said opening means extending over substantially the entire width of the form cylinder, said blast box having at least one fan means within the box for forcing air out through said opening means, an air cooler means within the box located in between the fan means and the blast opening means for tempering the air generated by the fan means, means outside said box for supplying fluid coolant to the cooler means, and temperature regulator means for regulating cooling by the tempered air.

2. In the anaqueous offset printing system of claim 1 wherein said cooler includes a cooling hose, said means for supplying fluid coolant includes a moistening water cooling apparatus disposed outside said blast box and having a water in-flow line and a water out-flow line, and means for connecting said cooling hose to said water in-flow and out-flow lines.

3. In the anaqueous offset printing system of claim 2 wherein said regulator means includes a thermostatically controllable choke valve disposed in the water out-flow line of the water cooling apparatus for regulating the cooling of the directed air in dependence on the temperature of the fluid coolant.

* * * * *